US008505457B2

(12) United States Patent
Scherrer et al.

(10) Patent No.: US 8,505,457 B2
(45) Date of Patent: Aug. 13, 2013

(54) CONTOURED THICKNESS BLANK FOR AMMUNITION CARTRIDGES

(75) Inventors: Daniel Keith Scherrer, Monroe, OH (US); Joseph Alan Douthett, Monroe, OH (US)

(73) Assignee: AK Steel Properties, Inc., West Chester, OH (US)

( * ) Notice: Subject to any disclaimer, the term of this patent is extended or adjusted under 35 U.S.C. 154(b) by 0 days.

(21) Appl. No.: 13/182,973

(22) Filed: Jul. 14, 2011

(65) Prior Publication Data

US 2012/0012024 A1 Jan. 19, 2012

Related U.S. Application Data

(60) Provisional application No. 61/364,236, filed on Jul. 14, 2010.

(51) Int. Cl.
*F42B 5/28* (2006.01)

(52) U.S. Cl.
USPC ..... 102/464

(58) Field of Classification Search
USPC ..... 102/464, 430, 469; 86/10, 19.5, 86/19.6, 19.7
See application file for complete search history.

(56) References Cited

U.S. PATENT DOCUMENTS 2,462,851 A * 3/1949 Fawcett et al. ..... 148/643
3,614,816 A 10/1971 Weyhmuller et al.
4,077,727 A 3/1978 Kramer et al.
4,077,807 A 3/1978 Kramer et al.
4,259,892 A 4/1981 Witt et al.
4,296,536 A 10/1981 Hicke
4,437,488 A 3/1984 Taggart et al.
4,455,942 A 6/1984 Murray et al.
4,572,078 A 2/1986 Bell
4,775,332 A 10/1988 Bowden, Jr. et al.
4,940,204 A 7/1990 Nelson et al.
5,157,833 A 10/1992 Kohama et al.
5,233,902 A 8/1993 Bernardes
5,507,232 A 4/1996 Valdez
5,515,766 A 5/1996 Fleury (Continued)

FOREIGN PATENT DOCUMENTS

BE 531 737 A 12/1957

OTHER PUBLICATIONS

Ammunition: How Products are Made, http;//www.enotes.com/how-products-encyclopedia/ammunition/print, printed Sep. 13, 2011, pp. 1-5.
Cartridge(firearms) http://en.wikipedia.org/wiki/Cartridge_(firearms), printed Sep. 13, 2011, pp. 1-9.

(Continued)

*Primary Examiner* — Stephen M Johnson
*Assistant Examiner* — John D Cooper
(74) *Attorney, Agent, or Firm* — Frost Brown Todd LLC

(57) ABSTRACT

An austenitic stainless steel ammunition cartridge includes an outer region and a base, wherein the outer region is about 50%-80% of the thickness of the base, which serves to minimize the sidewall ironing required to form the cartridge. The cartridge blank can be formed by spin forming, compression forming, grinding, or a combination thereof. Tooling to form the insert can include at least a pair of blocks and inserts, at least one insert defining a centrally positioned aperture.

1 Claim, 6 Drawing Sheets

(56) References Cited

U.S. PATENT DOCUMENTS

| | | | | |
|---|---|---|---|---|
| 5,664,727 | A | 9/1997 | Beall | |
| 5,685,100 | A | 11/1997 | Atchison | |
| 5,714,707 | A | 2/1998 | Ruia | |
| 5,758,446 | A | 6/1998 | Atchison | |
| 5,937,892 | A | 8/1999 | Meisner et al. | |
| 6,672,219 | B2 | 1/2004 | Macherell et al. | |
| 7,004,074 | B2 | 2/2006 | Van Stratum | |
| 2007/0214992 | A1 * | 9/2007 | Dittrich | 102/469 |
| 2013/0025438 | A1 | 1/2013 | Scherrer | |

OTHER PUBLICATIONS

How Cartridge Brass is Made, Accurate Shooter, http://bulletin.accurateshotter.com/2007/06/how-cartridge-brass-is-made, printed Jun. 30, 2011, pp. 1-16.

International Preliminary Report on Patentability dated Jan. 24, 2013 for Application No. PCT/US2011/043995.

English Machine Translation of Belgian Patent BE 531 737, Dec. 1957.

US 5,082,508, 01/1992, Nelson (withdrawn)

* cited by examiner

CONTOURED THICKNESS BLANK FOR AMMUNITION CARTRIDGES

PRIORITY

This application claims priority to U.S. Provisional Patent Application Ser. No. 61/364,263, filed Jul. 14, 2010, entitled "CONTOURED THICKNESS BLANK FOR AMMUNITION CARTRIDGES," the disclosure of which is incorporated by reference herein.

BACKGROUND

Ammunition includes metallic cases or cartridges, commonly made of brass, which each package a bullet, gunpowder, and primer. The filled cartridge is formed to precisely fit a firing chamber of a firearm.

The manufacture of such brass cartridges is generally known to include annealing a cup of heavy-gauge brass and deep drawing the cup through a multi-stage press arrangement into a final shape of the cartridge. The process for brass further includes ironing cartridge sidewalls during drawing and re-drawing processes to taper the walls with respect to the base, with multiple intermediate anneals conducted between the deep drawing processes.

Brass, having a sufficiently low work hardening rate and low frictional forces, is usable with a multiple annealing and sidewall ironing process, and is suitable for such a deep drawing process including heavy sidewall ironing. Steel, by contrast, has properties such as a high work hardening rate, high strength, and high frictional forces. These properties can lead to galling and scoring issues, which typically result in reduced die life and make heavy sidewall ironing during repeated re-drawing and annealing steps difficult and not generally feasible. Also, while carbon steel has been used to form cartridges, such cartridges included waxing, or application of a protective coating, to prevent rust.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
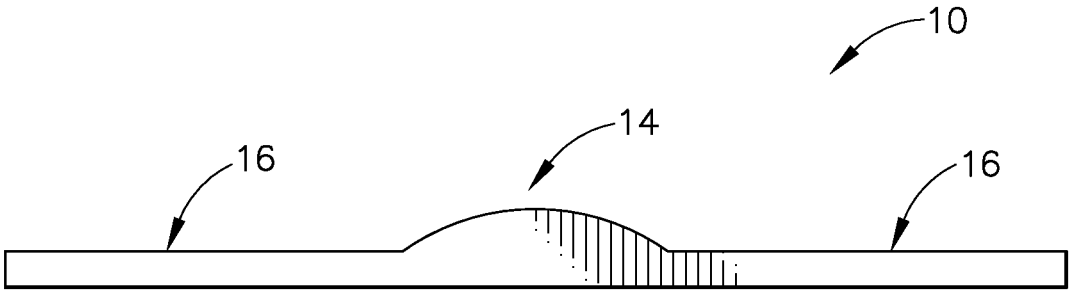
FIG. 1 depicts a cross-sectional view of an ammunition cartridge blank according to an example of the present disclosure in a first state.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description. As will be realized, the invention is capable of other different and obvious aspects, all without departing from the invention. Accordingly, the drawings and descriptions should be regarded as illustrative in nature and not restrictive.

The Blank

Figure 2:
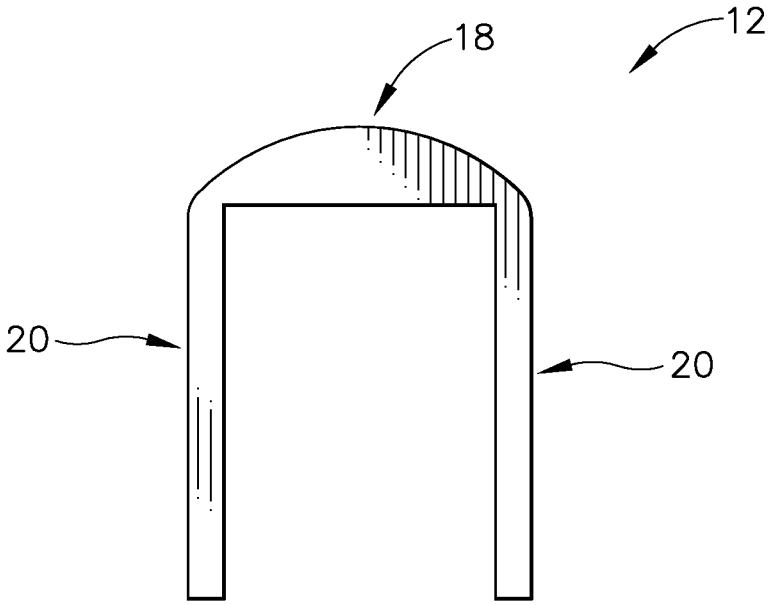
FIG. 2 depicts a cross-sectional view of the ammunition cartridge blank of FIG. 1 in a second, formed cartridge state.

FIG. 1 illustrates exemplary cartridge blank (10) in a first state, and FIG. 2 illustrates it in a second state as a cartridge (12) drawn into a cylindrical shape after a first draw operation, for example. Exemplary contoured thickness blank (10), formed into a first state as described further below, is shown in FIG. 1 as having central button (14) and outer region (16). The thicker central button (14) becomes the base of the cylindrical cartridge in the second state. Outer region (16) is reduced a minimum of 50% of the thickness of button (14), allowing for a minimization of side-wall ironing when drawing cartridge (12) into the cylindrical form. As shown in FIG. 2, and as described below, blank (10) of FIG. 1 is further processed to form cartridge (12) of FIG. 2, such that button (14) becomes base (18) of cylindrical cartridge (12).

Blank (10) may be formed of a metal including but not limited to austenitic stainless steel. Austenitic stainless steel is known to those of ordinary skill in the art. It is an alloy including chromium and nickel, having austenite as a primary phase. This alloy exhibits high ductility, low yield stress, and high tensile strength when compared to other steels. An austenitic stainless steel composition may comprise, for example, weight percentages of approximately no more than 0.045% C, no more than 0.60% Si, from about 0.03% to 0.06% $N_2$, from about 1.0% to about 1.4% Mn, from about 17.2% to about 17.8% Cr, from about 3.1% to about 3.4% Cu, from about 8.1% to about 8.4% Ni, no more than 0.035% P, no more than 0.002% S, and no more than 0.4% Mo. Alternatively, the austenitic stainless steel composition may comprise, for example, weight percentages of approximately 0.035% C, 0.45% Si, 0.045% $N_2$, 1.2% Mn, 17.5% Cr, 3.25 Cu, 8.25% Ni, a low weight percentage of each of P and S, and 0.2% Mo. The above-described compositions are shown in TABLE 1 below, where M=maximum amount.

TABLE 1

| Chemical Composition for austenitic stainless steel (measured by weight percent) | | | | | | | | | | |
|---|---|---|---|---|---|---|---|---|---|---|
| | C | Si | $N_2$ | Mn | Cr | Cu | Ni | P | S | Mo |
| Range | 0.045M | 0.60M | .03/.06 | 1.0/1.4 | 17.2/17.8 | 3.1/3.4 | 8.1/8.4 | .035M | .002M | 0.4M |
| Aim | 0.035 | 0.45 | 0.045 | 1.2 | 17.5 | 3.25 | 8.25 | low | low | 0.2 |

In a cold-rolled and annealed condition, such an austenitic stainless steel may have mechanical properties including 0.2% yield strength=31.5 ksi; ultimate tensile strength (UTS)=77.5 ksi; total elongation to fracture (based on an original gage length of 2")=52.5%, and n-value (10% to Ult.)=0.404, and hardness of 68 HRBW. Such properties may be retrieved from a standard uni-axial tension test, conducted in accordance with ASTM E 8 and A 370. The n-value or strain hardening exponent is obtained at the same time but method of determination is covered under ASTM E646. Material tested in the examples described below, and the austenitic stainless steel described above, for example, may be melted, hot rolled between from about 2250° F. to about 2320° F., strip annealed between from about 1950° F. to about 2000° F., cold rolled, and finally annealed at about 1950° F.

The blanks may be prepared by any method known in the art. FIGS. 3-7 illustrate methods to prepare blank (10) in its first state. In their first state, the blanks may include an outer region (16) surrounding button (14) such that outer region (16) has a thickness in the range of from between about 50% to 80% of the thickness of central button (14). For example, sidewalls (20) as shown in FIG. 2 may be in the range of about 0.015 to 0.025 inches, and base (18) may have a thickness that is greater than the sidewall thickness. Such a greater comparative thickness requires minimal ironing during a forming process to position outer region (16) from the first state of FIG. 1 to the second state of FIG. 2 in which outer region (16) forms sidewalls (20). In another example, the blanks may include outer region (16) surrounding button (14) such that outer region (16) has a thickness in the range of from between about 50% to 60% of the thickness of central button (14).

Figure 3:
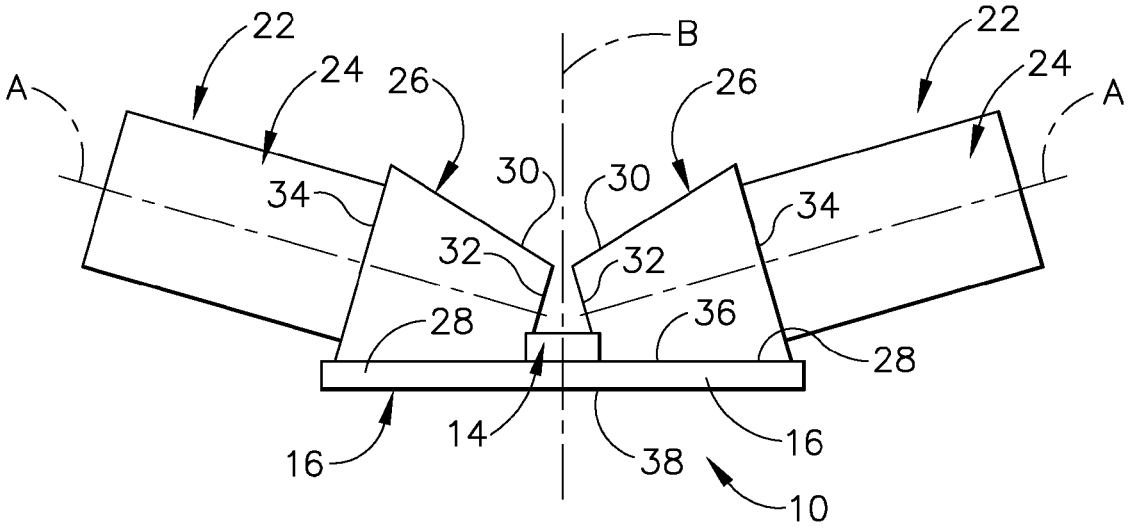
FIG. 3 depicts an elevation view of an exemplary spin forming operation.
Figure 4:
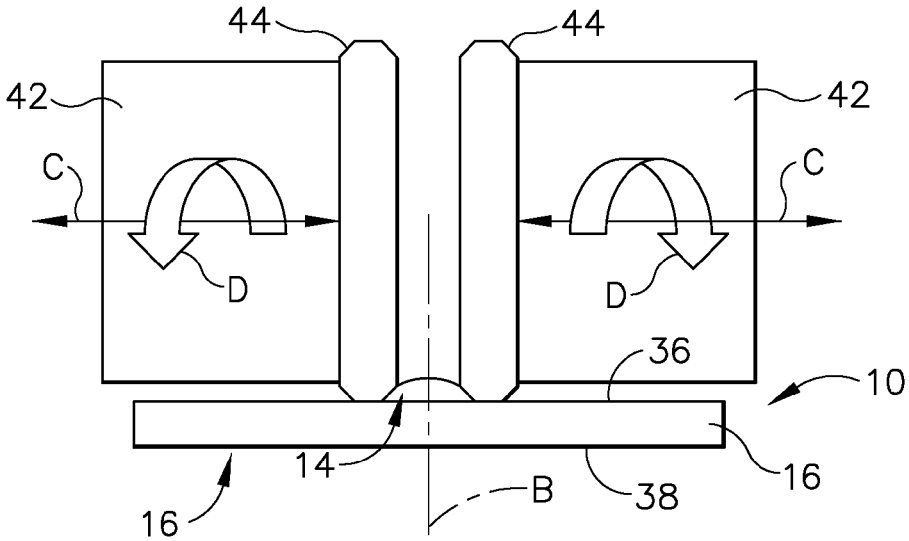
FIG. 4 depicts an elevation view of another exemplary spin forming operation.

The blank may be spin formed as shown in FIG. 3 or FIG. 4. Referring to FIG. 3, arms (22) of a rolling machine may include shafts (24) and heads (26) and rotate about respective longitudinal axes (A) of shafts (24). Each head (26) is generally trapezoidally shaped, though other shapes may be apparent to those of skill in the art. Head (26) includes a first, generally horizontal, blank contacting surface (28), an opposite second surface (30), and third and fourth surfaces (32, 34) disposed therebetween at respective ends of first and second surface (28, 30). Third and fourth surfaces (32, 34) are generally parallel to one another, and axis (A) is substantially perpendicular to third and fourth surfaces (32, 34).

Blank (10) includes a machine contacting surface (36) and an opposite underside surface (38). Surfaces (36, 38) are disposed generally parallel to one another. Blank (10) includes central axis (B) that is substantially perpendicular to head contacting surface (36). Blank (10) rotates about central axis (B) while one or more arms (22) of the rolling machine rotate about respective longitudinal axes (A) such that blank contacting surface (28) of head (26) of a rotating arm (22) works against machine contacting surface (36) of blank (10) to form button (14) and outer region (16), button (14) having a greater thickness than outer region (16). Alternatively, arms (22) may rotate while blank (10) remains stationary.

Alternatively, as shown in FIG. 4, a rolling machine may include shaft (42) having longitudinal axis (C) and annular arm (44) rotatable about longitudinal axis (C) of shaft (42), for example, as shown in the direction of arrow (D). Blank (10) is formed to include button (14) and outer region (16), as described above, in this exemplary version as portions of rotating arm (44) work against machine contacting surface (36) of blank (10) while blank (10) rotates about central axis (B). Alternatively, arms (44) may rotate while blank (10) remains stationary.

Figure 5:
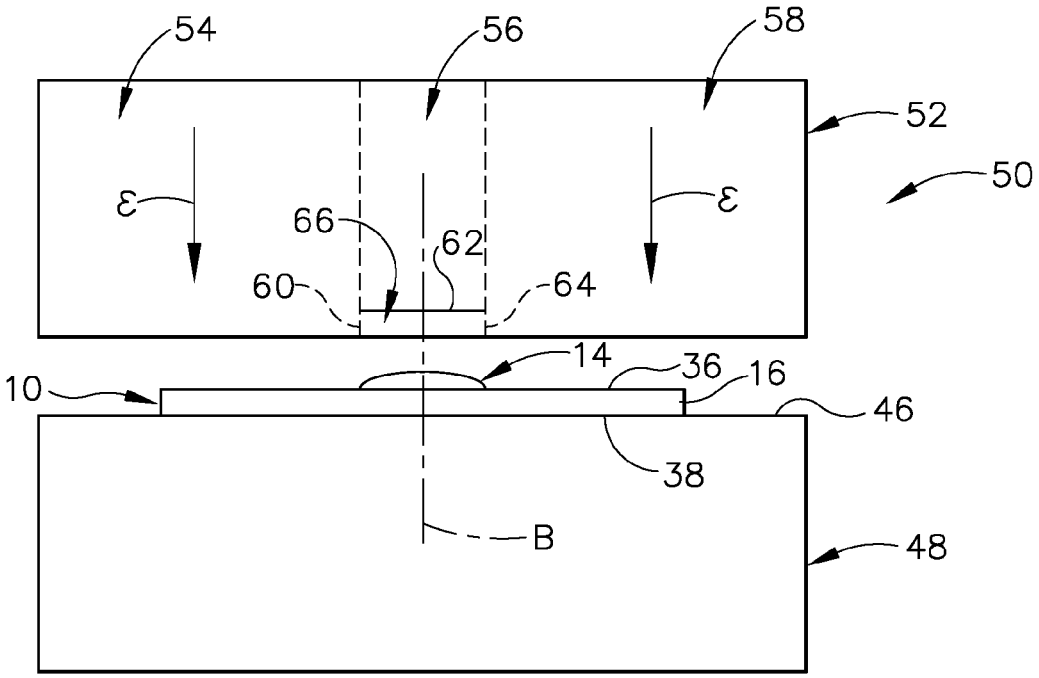
FIG. 5 depicts an elevation view of an exemplary compression forming operation.

The blanks may be compression formed by cold forming, warm forming, hot forming, or forging under straight compressive loading. As shown in FIG. 5, blank (10) may be placed on upper surface (46) of lower block (48) of press (50). Upper block (52) of press (50) may include first portion (54), second portion (56), and third portion (58), with second portion (56) disposed between first and third portions (54, 58). First and third portions (54, 58) may be substantially rectangular or square in shape, while other shapes are within the scope of this disclosure. First and third portions (54, 58) may have a substantially linear underside to compress against blank (10) to form outer region (16) when driven in the direction of arrow (E). Second portion (56) includes walls (60, 62, 64) defining aperture (66), sized and configured to compress against blank (10) to form button (14). The two halves of the press are brought together, in a manner known in the art, to form the blank (10).

Figure 6:
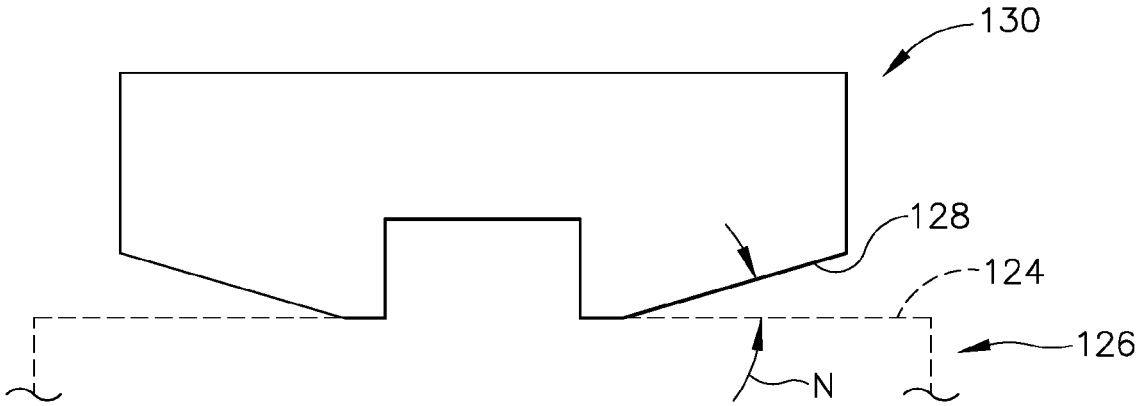
FIG. 6 depicts an elevation view of a die for an alternative exemplary compression forming operation.

Further, the process may involve using a three-die compression tooling design. The first and second dies may appear similar to that shown in FIG. 5 with the exception that the lower surface of the top press may be angled with respect to the upper surface of the bottom press, as shown in FIG. 6. For example, FIG. 5 shows flat, parallel surfaces between the top and bottom presses. FIG. 6 shows a die having a non-parallel surface between the top and bottom presses. The first die may include, for example, a flat, upper surface (124) for the bottom press (126), as shown in phantom in FIG. 6. The first die may additionally include an angled, lower surface (128) for top press (130) that is angled with respect to flat upper surface (124) of bottom press (126) at angle (N). Angle (N) may be, for example, 1 degree, such that an exterior end of the angled, lower surface of the top press is about 0.018" removed from the upper surface of the lower press when the two presses are in compression. Alternatively, angle (N) may be in the range of about 0.1 degree to about 5 degrees. The slope added to the firm two forming stages via the first and second dies may, for example, assist with the flow of blank material outwards as the material may be moved more gradually and forced outward by the above-describing angling of the lower surface of the top press with respect to the upper surface of the bottom press.

Figure 7:
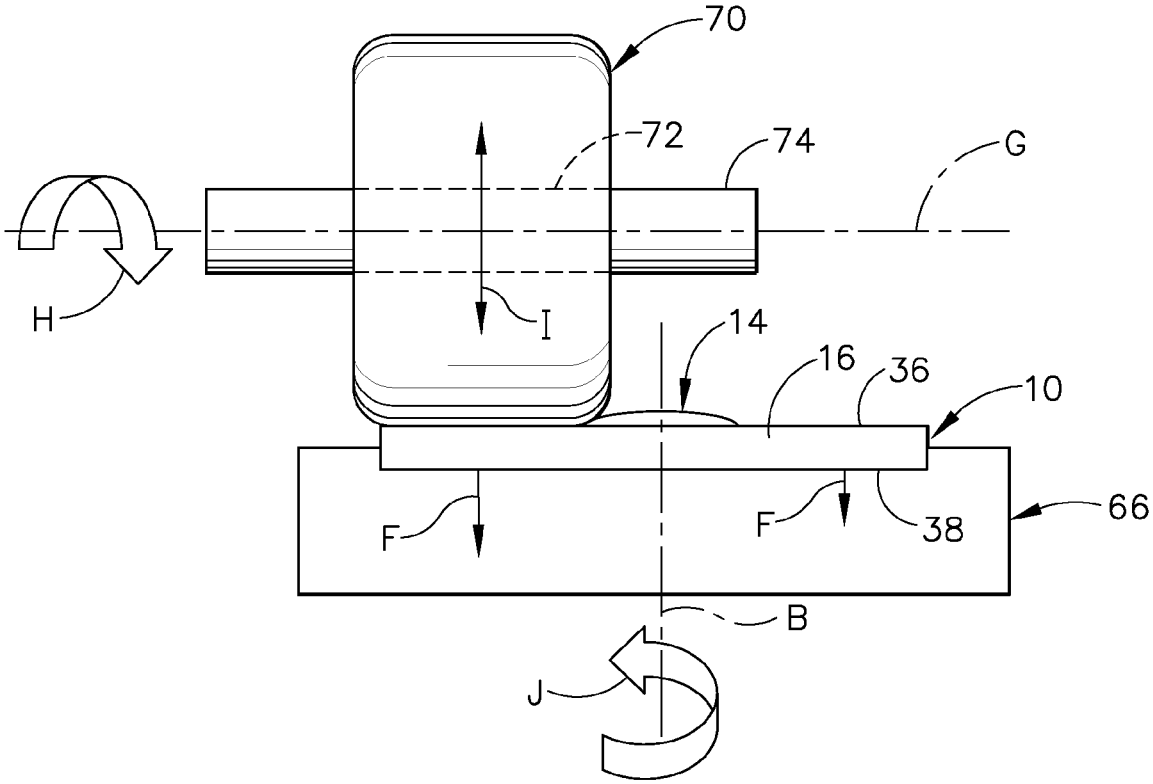
FIG. 7 depicts an elevation view of an exemplary grinding operation.

Alternatively, an exemplary grinding operation as shown in FIG. 7 may be used to form blank (10). Blank (10) can be suction or vacuum held to lower block (68) by downwards force (F). As shown in FIG. 7, arm (70) includes central aperture (72) through which shaft (74) extends. Shaft (74) includes substantially horizontal, longitudinal axis (G), about which shaft (74) rotates in the direction of arrow (H). Such rotation, via, for example, intermeshing gear mechanisms (not shown) may effect an upper and lower vertical movement, as shown by arrow (I), substantially in a direction perpendicular to longitudinal axis (G) of shaft (74). Alternatively, shaft (74) may non-rotably move in a direction substantially perpendicular to axis (G) to effect a similar movement of arm (70). Arm (70) is moved to a position to grind against blank (10) to create outer region (16) as blank (10) rotates about central axis (B) in the direction of arrow (J), for example. Additionally and/or alternatively, arm (70) may effect downward strokes while grinding against blank (10), which may be rotatable or non-rotatable.

Figure 8:
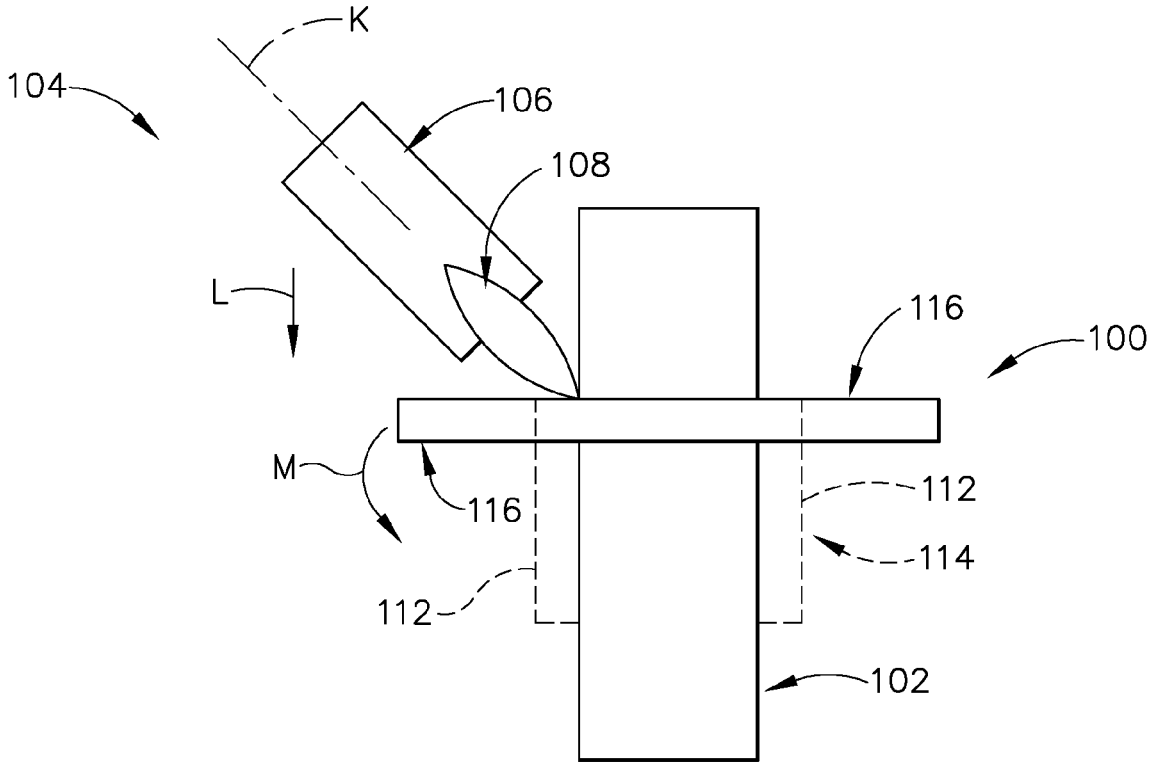
FIG. 8 depicts an elevation view of yet another exemplary spin forming operation.

Alternatively, as shown in FIG. 8, a blank may be directly formed into a cylindrical cartridge shape via a spin forming operation. For example, a flat blank such as blank (100), approximately 0.06" thick, may be spin formed over lower support (102) into a cylindrical shape. Spinning machine (104) may include shaft (106) and arm (108) extending from shaft (106), together forming shaft and arm assembly (110). Shaft and arm assembly (110) may rotate about longitudinal axis (K) of shaft and arm assembly (110), and blank (100) may remain stationary as shown in FIG. 7 or may concurrently rotate about a longitudinal axis of blank (100). Shaft and arm assembly (110) may move downwards in the direction of arrow (L) to form sidewalls (112) of cylindrical cartridge (114), which is shown in phantom in FIG. 7. For example, outer region (116) of blank (110) may be formed downwards in the direction of arrow (M) to form sidewalls (112).

Figure 9:
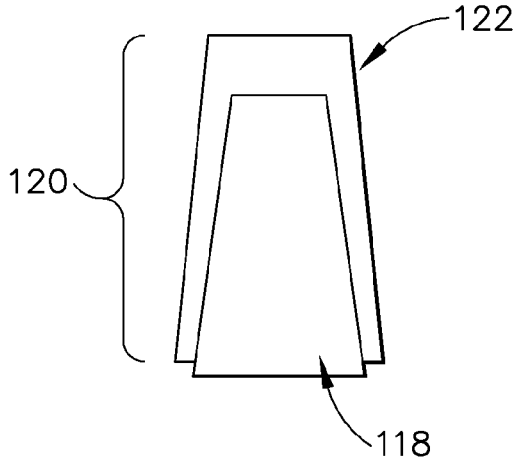
FIG. 9 depicts an elevation view of an exemplary plunger and cylindrical cartridge formed via the plunger.

Alternatively, as shown in FIG. 9, a contoured plunger (118) having a top width that is less than a bottom width may be used to allow for thickness variation along length (120) of cylindrical cartridge (122), which is required in the final cartridge shape. The process may occur in a single operation requiring no additional, intermediate steps to produce the cylindrical shape, which may eliminate, for example, three to four intermediate annealing steps. Additionally three of the initial draw operations otherwise required to form the cylindrical shape from a simple contoured flat blank may be eliminated, as described below. Optionally, the center button may be brazed at about 0.04" thickness to a circular flat of about 0.020" thickness.

Figure 10:
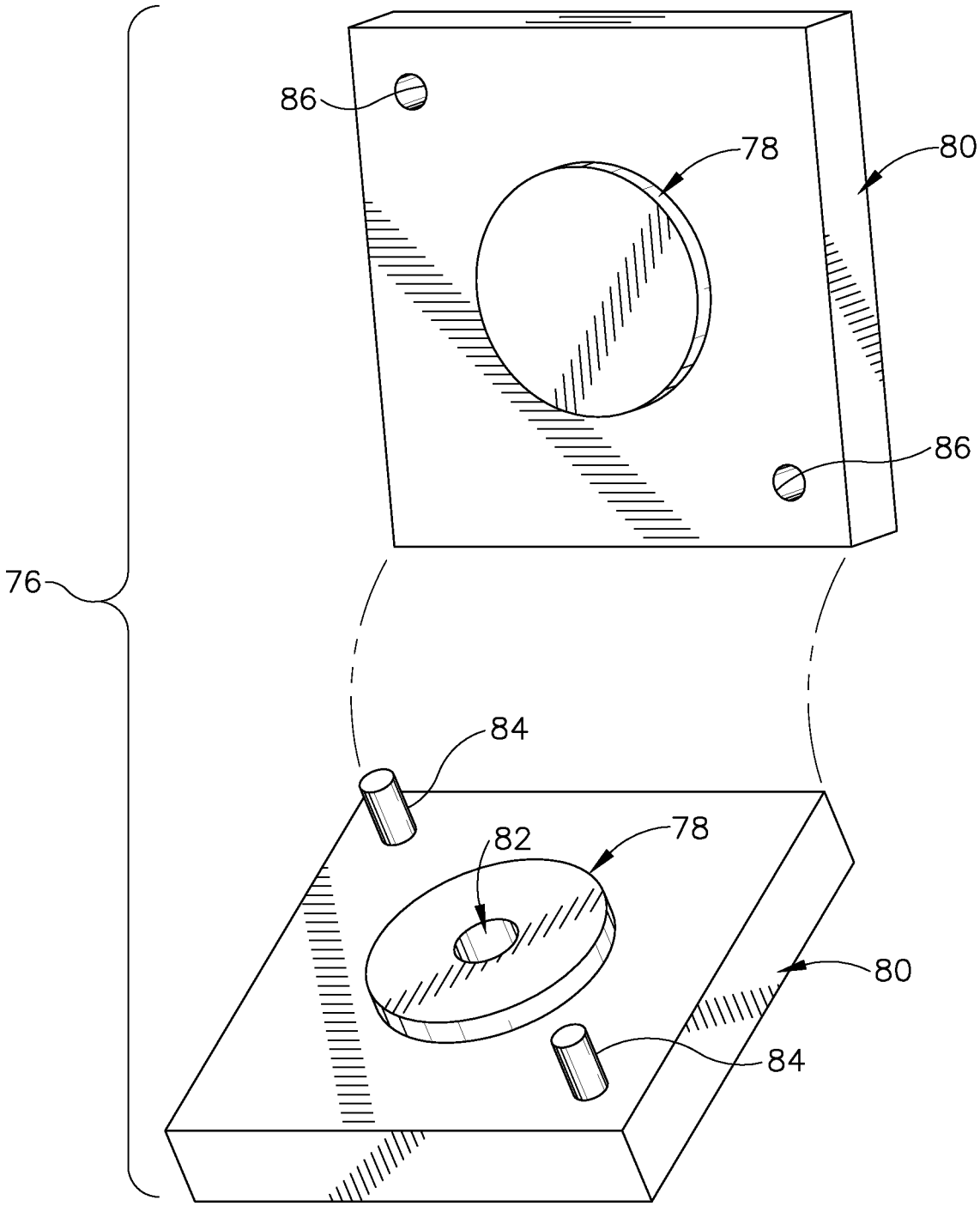
FIG. 10 depicts an exploded perspective view of exemplary tooling.

Alternatively, tooling (76) to form the blanks may be used. Such tooling includes inserts (78) and blocks (80) as shown in FIG. 10. Inserts (78) may be made of D-2 tool steel, for example, and have central plates that are 2" in diameter, ⅜" thick, and have a hardness of 61 HRC. The blocks (80) may be made of O-6 tool steel, for example, and have a hardness of 59 HRC. At least one of inserts (78) may include central aperture (82) extending therethrough. Central aperture (82) may be 0.5" in diameter, for example. Block (80) may include guide pins (84) configured for receipt into blind bores (86) of block (01), though guide pins (84) could be configured for receipt into apertures defined in and extending through block (80).

An alternative exemplary tooling is made from Carpenter 883 (type H13) tool steel, made by CARPENTER TECHNOLOGY CORPORATION of 2 Meridian Blvd., Wyomissing, Pa., 19610-1339, which is a 5% chromium hot working tool steel usable for applications requiring extreme toughness. For example, the type H13 tool steel is known to have an ability to be used in hot forming and/or forging. With such steel tool, forming may be conducted at room temperature under static loading. An option is provided with the tooling to attempt to heat the die and the material. The type H13 tool, however, performs well with respect to cold forming as the tooling resists cracking and distortion to the loading surface (i.e., the surfaces remain flat and parallel).

Any shape for such tooling can be used as will be apparent to those of skill in the art in view of the teachings herein. For example, such tooling may include cylindrical blocks that are sized to create properly sized blanks. Alternative exemplary tooling may include S-7, which is an air hardening grade tool steel with 0.55% carbon, 3.25% chromium, and 1.4% molybdenum. Any tool steel can be used as will be apparent to those of skill in the art in view of the teachings herein based on factors such as cost and desired production life.

The above described tooling can be heat treated. A method of heat treating exemplary tooling, such as the above-referenced type H13 tooling, includes sealing the tool, or tooling, in stainless steel bags. The bags minimize surface oxidation of the tooling during the annealing process. Tooling should be protected from oxidation during the annealing either physically during annealing via a cover or protective holder such as the stainless steel bags or chemically via a controlled atmosphere. For example, in a controlled atmosphere, the bags would not be necessary.

The bags containing the tool steel are placed directly in a furnace at 1400° F. for 4 hours, heating from 1400° F. to 1850° F. at 50° F./hour increments, and holding at 1850° F. for 6 hours. The bags are then removed from the furnace and air cooled to 650° F. At 650° F., the bags are placed into the furnace and cooled at 50° F./hour increments to 200° F. and then air cooled once more to 120° F. Tempering occurs by placing the tooling in the furnace at 1000° F. for 6 hours and then air cooling to room temperature. Finally, the surfaces of the tooling are polished.

With respect to tooling including a center hole, the hardness of the blocks may be in the range of from about 54 HRC to 63 HRC, and without a center hole the hardness may be about 48-49. Generally, as hardness increases, so does strength; however, the material also becomes more brittle. An estimated yield strength based on hardness may be in the range of from about 200 ksi to 220 ksi.

While use of tooling with intermediate annealing steps are presented in the examples below, use of an annealed blank without any further annealing steps after beginning work operations on the blank are within the scope of this disclosure.

Exemplary Formation of Blanks into Cartridges

Blank (10) of FIG. 1 may be formed into the second state shown as cylindrical cartridge (12) of FIG. 2 and into a final cylindrical form after multiple draw reductions, for example, to obtain final, straight-walled cylinder dimensions. For example, work performed on austenitic stainless steel, with a composition as described above, at 0.01" thickness and for a blank having a diameter of 2" may have the following results at sequential forming stages: (1) a draw ratio of 1.7 and a diameter of 1.17", (2) a draw ratio of 1.33 and a diameter of 0.88", (3) a draw ratio of 1.33 and a diameter of 0.665", (4) a draw ratio of 1.33 and a diameter of 0.500", and (5) a draw ratio of 1.32 and a diameter of 0.378". Draw reduction as measured above equals an initial diameter divided by the final diameter after each stage of formation. Such a five-stage sequential reduction is known to those skilled in the art for the drawing of brass cartridges, for example, except that specific austenitic stainless steel as described above may not require intermediate anneals between the formation stages. While a five-stage process is described, it is within the scope of the disclosure to use a more aggressive four-stage process and eliminate one of the reductions, which may result in draw ratios of 2, 1.4, 1.4, and 1.33 after each stage.

Additional required forming operations include the following: (1) an operation to form a reduced neck diameter, (2) an operation to form the cartridge rim, and (3) an operation to create a region in the rim that is configured to accept a primer cap, for example. The forming operations used may ones known to those of ordinary skills in the art that will be apparent in view of the teachings herein.

EXAMPLES

The blanks described in the examples below were pre-annealed. The initial blanks were formed from material going through a 50% to 60% cold reduction followed by a full anneal.

Example 1

The forming process was tried on easier-to-form low carbon steel, having lower strength with lower work hardening than a higher carbon steel and having a range of about 0.05 to 0.15 C, for example. A 600 Kip Tinius Olsen universal testing machine and hardness blocks were used to conduct trials on the low carbon steel, for example, initially with a blank originally having a 2.06" diameter and 0.04" thickness. Starting at 100 Kip, the blank was loaded in 50 Kip increments such that a final blank was 2.22" in diameter and 0.031" thick at a center portion with a gradual taper to the edge, which had a 0.021" thickness. A smaller blank with a diameter of 1.53" was then tested to get higher compressive stress for the same amount of force. The final diameter for the smaller blank was 1.70", the final center thickness was 0.0307", and the final edge thickness was 0.016".

Example 2

An ASTM specification T301 stainless steel blank was formed. The T301 stainless steel blank had mechanical properties closer to the austenitic stainless steel composition described above, though the T301 stainless steel blank had a higher work hardening rate. The T301 stainless steel blank had an original diameter of 1.53" and original thickness of 0.0472". Going to 300 Kips in 100 Kip increments, a final diameter of 1.625", final center thickness of 0.045", and final quarter edge thickness of 0.039" resulted. Hardness blocks were used as compression tools and, as such, were not shaped but were, for example, substantially flat. Hardness blocks were used as they were contemplated to be in the hardness range most suitable for this application. The hardness blocks used were 42 HRC and were slightly deformed after the forming was completed. These blocks were replaced with blocks of 62 HRC. The process was repeated, loading to 350 Kip, and unloading at 400 Kip. The final diameter was 1.64" with a hardness of 85-100 HRB. When annealed at 1825° F., the hardness dropped to 53-58 HRB. After ultimately loading to 400 Kips, the final diameter was 1.76", the final center thickness was 0.043", the final edge thickness was 0.030", and the final hardness was 90-93 HRB. The hardness blocks of 62 HRC eventually cracked, and it is expected that thicker blocks might prevent such cracking. Other tooling produced from S-7 tool steel and which generated forces up to 2.4 million lbs was later used and did not crack.

Example 3

An ASTM specification T305 stainless steel blank was formed. The hardness blocks were replaced with compression plates, which included one flat plate and one with a 0.5" diameter central hole. The plates were machined from available D-2 tool steel.

Tooling was next machined to include a central opening to make buttons (14) and was designed with replaceable compression inserts. The base was made from O-6 tool steel and inserts made from D-2 tool steel, and both base and inserts were in the high 50 HRC hardness range.

The T305 stainless steel blank was formed by loading to 250 Kips in 50 Kip increments, with a complete unloading between increments. Thickness was measured at three locations: the center ("T1"), ⅛" from button ("T2"), and ⅛" from the outer edge ("T3"). The final measurements followed: diameter=1.61", T1=0.048", T2=0.0414", and T3=0.039". The material was then loaded to 300 Kip, 350 Kip, and 400 Kip, resulting in the following final measurements: diameter=1.63", T1=0.048", T2=0.040", and T3=0.039". Hardness at position T2 was approximately 59.3 HRA (96.5 HRB), and hardness at position T3 was about 61.3 HRA (22 HRC). This test resulted in the tooling cracking and the central button dimpling up. The dimpling up was a result of the material being forced into an open region during compression. Thus a desired thickening occurred with an undesired buckling, resulting in realization of the need to have tougher tooling and to control the height of the opening. For example, a rod was inserted in an initial trial open hole in the tooling insert to form the button and to allow for proper clearance. Spacers were used to control the height of the tooling with respect to the blank in a vertical direction to prevent the material from buckling up. The height may be fixed or adjustable via spacers, for example.

Example 4

A plate or insert with 0.5" central opening was used on both the top and bottom ends of the tooling to address dimpling. An insert to control height was used on only one side. Another blank with a diameter of 1.5" was loaded to 250 Kips in 50 Kip increments, resulting in the following final measurements: diameter=1.6", T1=0.050", T2=0.0424", and T3=0.090". The central button did not dimple as severely but did bulge such that the top surface did not remain completely flat. Additional shims were added to the top surface of a rod inserted in the central opening of the tooling to lower the height of the insert and adjust the clearance downwards.

Example 5

A standard grade T305 stainless steel button blank was used. The buttons were cold reduced at room temperature four times with intermediate anneals at 1850° F. after each compression cycle. The blank was loaded to 400 Kips (approximately 205 ksi of stress over the surface area) on the first cycle, then to 300 Kips (approximately 151 ksi of stress over the surface area), then to 350 Kips (approximately 148 ksi of stress over the surface area), and then to 375 Kips (approximately 155 ksi of stress over the surface area). After the fourth cycle, average thinning was measured at 39.7%. The annealing temperature was 1825° F. for 30 minutes for each annealing process.

With respect to the first work operation, the original diameter was 1.5", the original thickness for T1, T2, and T3 were each equal to 0.047". The final measurements after the first work operation follow: diameter=1.63", T1=0.048", T2=0.414", and T3=0.039". A hardness at T2 was measured at 97 HRB pre-anneal, and after annealing at 1825° F. at 54 HRB.

With respect to the second work operation, the starting measurements were the same as the final measurements for the first work operation set forth above. The final measurements for the second work operation follow: diameter=1.7", T1=0.0486", T2=0.0367", T3=0.0332". A post-anneal hardness was measured at T2 at 62.5 HRB.

With respect to the third work operation, the starting measurements were the same as the final measurements for the second work operation set forth above. The final measurements for the third work operation follow: diameter=1.78", T1=0.0494", T2=0.033", T3=0.0295". A hardness at T2 was measured at 88 HRB pre-anneal, and after annealing at 1825° F. at 76 HRB.

With respect to the fourth work operation, the starting measurements were the same as the final measurements for the third work operation set forth above. The final measurements for the fourth work operation follow: diameter=1.86", T1=0.049", T2=0.0302", T3=0.0265".

Inserts of the tooling initially cracked under the formation process prior to the base fracturing. Forces used were up to 400,000 lbs. The button blank expanded from approximately about 1.5" to about 1.9" and achieved approximately 40% thinning with two intermediate anneals.

Example 5

An austenitic stainless steel composition, as described above, of low work hardening characteristics, was formed into blanks. Austenitic stainless steel was reduced to 0.060" thickness and annealed for another set of trials. Material was machined into 1.5" diameter blanks that were reduced about 20% in thickness in a first compression cycle. Tooling heat-treated per the exemplary method described above was used, and button blanks received intermediate anneals and were reduced in thickness several more times, as described below.

The sequence used was as follows: loading 350 Kips of compressive force and then annealing the material at 1950° F., then loading to 425 Kips and annealing at 1950° F., followed by loading to 475 Kips and annealing at 1950° F., and finally to loading at 500 Kips and annealing at 1950° F. After each reduction, the initial hardness of 44.7 HRA was increased to an amount in the range of between 54.2 HRA to about 63.5 HRA, and after each anneal was decreased to an amount in the range of between 40.6 HRA to 44.1 HRA, as shown below in TABLE 2. Grain structure was inspected after the fourth anneal and found to be consistent with the grain structure of the original material.

TABLE 2 shows the measurements taken for hardness after each reduction and anneal. The codes represent four different button specimens tested, such that code 8 refers to a first button tested, code 16 refers to a second button tested, code 35 refers to a third button tested, and code 46 refers to a fourth button tested.

TABLE 2

Hardness Measurements

| | Hardness HRA (HRC) Reduction #1 Initial = 44.7 HRA | | | Hardness HRA (HRB) Anneal #1 | | |
|---|---|---|---|---|---|---|
| Code | quarter | edge | q, e average | quarter | edge | q, e average |
| 8 | 61.7 (23) | 61.8 (23) | 61.8 (23) | 43.4 (69) | 43.4 (69) | 43.4 (69) |
| 16 | 61.3 (22) | 63.5 (26.5) | 62.4 (24.3) | 43.4 (69) | 43.3 (69) | 43.4 (69) |
| 35 | 61.0 (21) | 61.8 (23) | 61.4 (22) | 44.1 (70) | 43.8 (70) | 44.0 (70) |
| 46 | 61.3 (22) | 61.7 (23) | 61.5 (22) | 43.6 (69) | 43.6 (69) | 43.6 (69) |

| | Hardness HRA (HRB) Reduction #2 | | | Hardness HRA (HRB) Anneal #2 | | |
|---|---|---|---|---|---|---|
| Code | quarter | edge | q, e average | quarter | edge | q, e average |
| 8 | 56.7 (92) | 56.8 (92) | 56.8 (92) | 42.1 (67) | 42.5 (67) | 42.3 (67) |
| 16 | 56.9 (92) | 55.8 (90) | 56.4 (91) | 42.4 (67) | 42.8 (68) | 42.6 (68) |
| 35 | 58.3 (95) | 59.5 (97) | 58.9 (96) | 42.3 (67) | 41.9 (66) | 42.1 (67) |
| 46 | 59.1 (96) | 59.0 (96) | 59.0 (96) | 42.6 (68) | 42.9 (68) | 42.7 (68) |

| | Hardness HRA (HRB) Reduction #3 | | | Hardness HRA (HRB) Anneal #3 | | |
|---|---|---|---|---|---|---|
| Code | quarter | edge | q, e average | quarter | edge | q, e average |
| 8 | 58.0 (94) | 56.6 (92) | 57.3 (93) | 41.6 (66) | 42.0 (67) | 41.8 (66) |
| 16 | 58.6 (95) | 58.0 (94) | 58.3 (95) | 42.0 (67) | 42.3 (67) | 42.1 (67) |
| 35 | 56.4 (91) | 53.4 (86) | 54.9 (89) | 40.6 (64) | 41.2 (65) | 40.9 (65) |
| 46 | 56.5 (92) | 54.0 (87) | 55.2 (89) | 41.1 (65) | 41.9 (66) | 41.5 (66) |

| | Hardness HRA (HRB) Reduction #4 | | | Hardness HRA (HRB) Anneal #4 | | |
|---|---|---|---|---|---|---|
| Code | quarter | edge | q, e average | quarter | edge | q, e average |
| 8 | 55.2 (89) | 54.2 (87) | 54.7 (88) | 41.6 (66) | 42.3 (67) | 41.9 (66) |
| 16 | 55.3 (89) | 54.6 (88) | 54.9 (89) | 41.9 (66) | 42.0 (67) | 41.9 (66) |
| 35 | 54.8 (89) | 54.0 (87) | 54.4 (88) | 41.6 (66) | 42.1 (67) | 41.8 (66) |
| 46 | 54.3 (88) | 53.6 (86) | 53.9 (87) | 41.3 (65) | 42.7 (68) | 42.0 (67) |

Referring back to the tested sequence, after a first reduction, the center thickness was measured at 0.0629", the percentage thinning of the outer region was measured at 19.79%, and the diameter was measured at 1.64". After the second reduction, the center thickness was measured at 0.0653", the percentage thinning of the outer region was measured at 32%, and the diameter was measured at 1.75". After the third reduction, the center thickness was measured at 0.0681", the percentage thinning of the outer region was measured at 41.24%, and the diameter was measured at 1.87". After the fourth reduction, the center thickness was measured at 0.0695", the percentage thinning of the outer region was measured at 46.50%, and the diameter was measured at 1.95".

In addition, some sequences were finally loaded to 600 Kips, such higher forces resulting into about an additional 5% of thinning, or just over 50% total thinning. For example, button blanks were cold reduced four times with an intermediate anneal after each forming stage and were compressed to a stress level of about 180 ksi in each stage. A total reduction level was achieved of just over 50% thinning with a final diameter of about 2.1".

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative. Accordingly, the scope of the present invention should be considered in terms of the following claims and is understood not to be limited to the details of structure and operation shown and described in the specification and drawings.

We claim:

1. An ammunition cartridge case, comprising:

(a) a base, the base having a first thickness; and (b) an outer region, the outer region having a second thickness, the first thickness greater than the second thickness by a percentage of at least 50%;

wherein the cartridge case comprises austenitic stainless steel; and wherein the base and the outer region comprise a monolithic, single piece of austenitic stainless steel; and wherein the austenitic stainless steel comprises weight percentages of from about 17.2 to about 17.8 Cr, from about 3.1 to about 3.4 Cu, and from about 8.1 to about 8.4 Ni.

* * * * *